US011370014B2

(12) United States Patent
Gomari et al.

(10) Patent No.: US 11,370,014 B2
(45) Date of Patent: Jun. 28, 2022

(54) SYSTEM AND METHOD FOR PASSIVE PIN POSITIONING AND LOCKING FOR RECONFIGURABLE FORMING DIES

(71) Applicants: Behnam Gomari, Tehran (IR); Farzam Farahmand, Tehran (IR); Hassan Farkhondeh, Tehran (IR)

(72) Inventors: Behnam Gomari, Tehran (IR); Farzam Farahmand, Tehran (IR); Hassan Farkhondeh, Tehran (IR)

(73) Assignee: SHARIF UNIVERSITY OF TECHNOLOGY, Tehran (IR)

( * ) Notice: Subject to any disclaimer, the term of this patent is extended or adjusted under 35 U.S.C. 154(b) by 940 days.

(21) Appl. No.: 15/716,421

(22) Filed: Sep. 26, 2017

(65) Prior Publication Data

US 2018/0015524 A1 Jan. 18, 2018

Related U.S. Application Data

(60) Provisional application No. 62/399,503, filed on Sep. 26, 2016.

(51) Int. Cl.
*B21D 37/02* (2006.01)
*B21D 22/02* (2006.01)

(52) U.S. Cl.
CPC ..... *B21D 37/02* (2013.01); *B21D 22/02* (2013.01)

(58) Field of Classification Search
CPC ..... B21D 37/02; B21D 22/02; B21J 13/02
See application file for complete search history.

(56) References Cited

U.S. PATENT DOCUMENTS 5,138,857 A * 8/1992 Siegert ..... B21D 24/08 72/21.1
5,187,969 A 2/1993 Morita
5,487,296 A * 1/1996 Gerhart ..... B21D 37/08 72/381
5,546,784 A * 8/1996 Haas ..... B21J 13/02 72/413
5,941,110 A * 8/1999 Cao ..... B21D 22/02 72/20.1
6,035,691 A * 3/2000 Lin ..... A61B 17/8863 72/212
6,053,026 A * 4/2000 Nardiello ..... B21D 25/02 72/297

(Continued)

OTHER PUBLICATIONS

D. T. Pham , Digital dieless tooling and jigless tooling technology for manufacturing 3D panels using multi-point forming methodology, 2017.

(Continued)

*Primary Examiner* — Adam J Eiseman
*Assistant Examiner* — Mohammed S. Alawadi
(74) *Attorney, Agent, or Firm* — Bajwa IP Law Firm; Haris Zaheer Bajwa

(57) ABSTRACT

A method and apparatus for passive pin positioning of a reconfigurable forming die is disclosed. The apparatus may include a plurality of pins disposed within a frame, and a bolt that when tightened can secure or lock the pins into position. When the bolt is loosened, the position of the pins can be adjusted. A preliminary model of a contoured surface that is to be imparted to an article by the reconfigurable forming die can be used to help define a forming surface of the reconfigurable die.

13 Claims, 7 Drawing Sheets

(56) References Cited

U.S. PATENT DOCUMENTS 6,089,061 A * 7/2000 Haas ..... B21D 37/16 72/14.8
6,209,380 B1 * 4/2001 Papazian ..... B21D 37/00 72/413
2003/0188562 A1 * 10/2003 Nieschulz ..... B21D 22/06 72/351
2009/0308131 A1 * 12/2009 Boers ..... B44B 5/0019 72/384
2010/0192661 A1 * 8/2010 Metzger ..... A61F 2/30942 72/457
2011/0048099 A1 * 3/2011 Cobzaru ..... B21J 15/043 72/453.17
2012/0279812 A1 * 11/2012 Peters ..... G05B 19/4099 188/67
2013/0086966 A1 * 4/2013 Park ..... B21D 35/002 72/294
2013/0316035 A1 * 11/2013 Nishiyama ..... B29C 33/0088 425/150
2015/0033818 A1 * 2/2015 Pyper ..... B21D 37/10 72/456
2017/0259319 A1 * 9/2017 Castellucci ..... B21D 11/20
2018/0065166 A1 * 3/2018 Lam ..... B21D 22/022

OTHER PUBLICATIONS

Daniel F. Walczyk, A Hydraulically-Actuated Reconfigurable Tool for Flexible Fabrication: Implementation and Control, Transactions of the ASME, 2000, vol. 122, 562-568.
Chunguo Liu, Principles and apparatus of multi-point forming for sheet metal, Int J Adv Manuf Technol, 2008, vol. 35, 1227-1233.
M.Z. Li, Multi-Point forming technology for sheet metal, Journal of Material Processing Technology, 2002, vol. 129, 333-338.
M-Z. Li, Principle and application of multi-point matched-die forming for sheet metal, Proc. IMechE, 2007, vol. 222, 581-589.
Abdulkareem Jalil Kadhim, Influence of Die Elements Shapes on Process Parameters in Multi-Point Sheet Metal Forming Process, 3rd International Conference on Management, Economics and Social Sciences, 2013, 145-150.

* cited by examiner

SYSTEM AND METHOD FOR PASSIVE PIN POSITIONING AND LOCKING FOR RECONFIGURABLE FORMING DIES

CROSS-REFERENCE TO RELATED APPLICATION

This application claims the benefit of priority from U.S. Provisional Patent Application Ser. No. 62/399,503, filed on Sep. 26, 2016, and entitled "METHODS FOR PINS POSITIONING AND LOCKING IN MULTI-POINT FORMING DIES" which is incorporated herein by reference in its entirety.

TECHNICAL FIELD

The present disclosure generally relates to reconfigurable forming dies and particularly to a passive method for adjusting and locking pins of a reconfigurable forming die.

BACKGROUND

Tooling design constitutes a significant aspect in the manufacture of most products. The current market is moving from a high-volume and low-mix design production to a low-volume and high-mix design production that utilizes diverse parts. Thus, essentially every part or component associated with a new device in a high-mix production requires a unique tool. Once design of a part is complete, an appropriate tool to produce the part is designed. Since a new forming die has to be used for each new application, designing and manufacturing a unique die for each unique part presents challenges to cost-efficiency. Furthermore, the attendant costs of testing and storing the new forming die for each part add to the problem.

In order to reduce the costs of producing individual forming dies, as well as the related inventory and storage costs, reconfigurable forming dies may be used in forming systems. A reconfigurable forming die may include a matrix of movable pins that are vertically adjustable and can be locked at a desired position to make a desired rigid surface contour. A reconfigurable forming die offers one type of adaptive tool for different forming processes, such as sheet metal forming. A reconfigurable forming die can replace numerous solid dies that are required in various forming processes. In other words, reconfigurable forming dies may be versatile and can quickly alter their surface contours, allowing for faster tool changes relative to traditional individual dies.

However, reconfigurable forming dies are associated with some drawbacks. For example, there are difficulties in exact pin positioning as well as the ability to retain their position or configuration under forming pressures. In a reconfigurable forming die, each pin requires an actuator that is utilized to position the pin. In addition, a mechanism to fix the pin at a desired position under relatively extreme forming pressures must be used. The inclusion of a respective actuator and fixing mechanism for each pin makes a reconfigurable forming die complex and costly. Therefore, there is a need in the art for a reconfigurable forming die, in which positioning the pins and retaining pin positions under the forming forces are accomplished with a simple and cost-effective method and mechanism.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

In one general aspect, the present disclosure is directed to a reconfigurable forming die for use in a forming system. The reconfigurable forming die includes a plurality of pins that are configured to move in a first direction substantially aligned with a vertical axis, a frame that houses the plurality of pins, and at least a first bolt configured to secure the plurality of pins into a fixed first position when the first bolt is fastened.

The above general aspect may include one or more of the following features. In one example, the plurality of pins is arranged in a matrix configuration. In another example, the reconfigurable forming die further includes a plurality of holes, where each hole is configured to receive one pin of the plurality of pins. The reconfigurable forming die may also include a plate, where fastening the first bolt causes the first plate to press against a lower end of each pin of the plurality of pins, thereby restricting movement of the plurality of pins in the first direction. In some cases, the reconfigurable forming die also includes a second bolt. In another example, the plurality of pins extends along the first direction and the first bolt extends in a direction that is substantially perpendicular to the first direction. In addition, in some cases, loosening the first bolt allows the plurality of pins to move along the first direction. In some implementations, an uppermost surface of at least one of the plurality of the pins is spherically ground. In other implementations, each of the plurality of holes is in fluid communication with a hydraulic pump through an inlet. In another example, the reconfigurable forming die further includes a pin positioning mechanism configured to hold each of the pins in a matrix arrangement, the pin positioning mechanism including the plurality of holes, and each of the plurality of holes being a through-hole. In some implementations, the pin positioning mechanism further includes the hydraulic pump that is configured to pump hydraulic oil into each of the holes through the inlet. As another example, the hydraulic pressure associated with the hydraulic oil pushes the pins in a direction away from the pump. In other implementations, the reconfigurable forming die also includes a plurality of check valves configured to prevent discharge of the hydraulic oil from each of the holes. In some other cases, each pin of the plurality of pins can be adjusted to a different height relative to an adjacent pin. Furthermore, the reconfigurable forming die can include a releasing matrix upon which a plurality of releasing pins are mounted, each releasing pin being configured to release a check valve associated with a hole of the plurality of holes. The reconfigurable forming die may also include a handle that is attached to the releasing matrix, where moving the handle in an upward direction causes a release of the plurality of check valves, and returns the plurality of pins to an initial position. In some implementations, the pin positioning mechanism further includes a matrix holding member, and the releasing matrix is mounted on a block that provides sealing for the matrix holding member and limits oil leakage. In another example, the reconfigurable forming die further includes an elastomeric material disposed directly above the plurality of pins. In some other implementations, each check valve includes a spring, a ball, and a set screw, and the spring is configured to apply a compression preload to the ball and hold the ball in contact with a conical surface of the set screw.

In another general aspect, the present disclosure is directed to a method of adjusting and securing pins of a reconfigurable forming die. The method includes moving a lower surface of a preliminary model toward a plurality of pins, the plurality of pins being arranged in an initial position, and loosening a bolt to allow the plurality of pins to move in a first direction substantially aligned with a vertical axis. The method also includes rotating the reconfigurable forming die and preliminary model such that gravity moves each of the plurality of pins until a first end of each of the plurality of pins contacts and presses against the lower surface of the preliminary model and are arranged in a forming position, and fastening the bolt, thereby securing the plurality of pins in the forming position.

The above general aspect may include one or more of the following features. In one example, the plurality of pins is arranged in a matrix, and fastening of the bolt involves pushing a plate against one side of the matrix. In another example the method can include positioning the plurality of the pins such that the first end of each of the pins is substantially tangential to the lower surface of the preliminary model, thereby forming surface contours substantially similar to that of the lower surface. In some implementations, the method also includes inserting each of the plurality of pins into a corresponding hole formed in a matrix holding member, each hole being in fluid communication with a hydraulic pump. In another implementation, the method may further involve pumping hydraulic oil into each of the holes. In some cases, the method may include three dimensional printing of the preliminary model using polyactic acid filaments as printing material. In another example, the method may include preventing vertical movement of the plurality of pins by application of hydraulic pressure. In some cases, the method may further include loosening the bolt and returning the plurality of pins to the initial position.

Other systems, methods, features and advantages of the implementations will be, or will become, apparent to one of ordinary skill in the art upon examination of the following figures and detailed description. It is intended that all such additional systems, methods, features and advantages be included within this description and this summary, be within the scope of the implementations, and be protected by the following claims.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
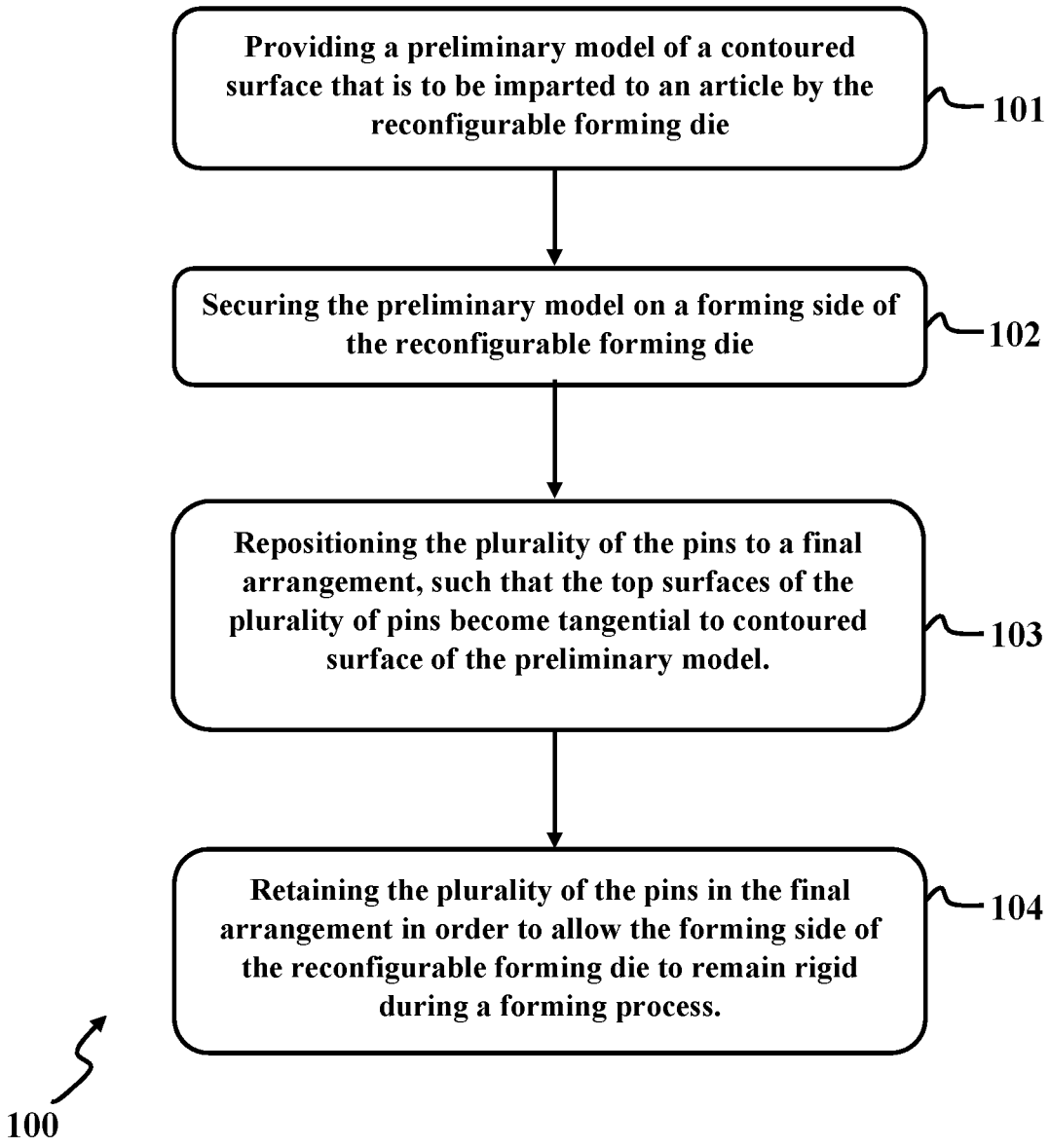
FIG. 1 illustrates a flow chart depicting an implementation of a method for adjusting and locking a reconfigurable forming die for a forming process.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings. The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

As will be discussed herein, systems and methods directed to adjusting pins of a reconfigurable forming die and retaining the positions of the pins during a forming process, such as a sheet metal forming process, are disclosed. As noted above, a reconfigurable forming die generally includes a plurality of pins that may be arranged in a matrix configuration. In some cases, the plurality of pins are arranged to stand close to one another in a series of rows and columns, and the top or outermost surfaces of the plurality of the pins may form a substantially continuous surface to provide a 'forming side' of the reconfigurable forming die.

It should be understood that the dimensions such as length, shape, width, thickness, and diameter, as well as the overall number of the pins, and the number of rows and columns of the matrix configuration of the matrix, may be configurable based on the requirements of the instant forming process. Each pin of the plurality of the pins in the matrix configuration may have a respective adjustable height. As a result of adjusting these respective heights, the surface contour of the forming side of the reconfigurable forming die may be altered and adjusted. Then, the reconfigurable forming die may be utilized to impart different two dimensional or three dimensional contours to a part or a sheet metal product.

In order to prepare a reconfigurable forming die for a forming process, each pin of the reconfigurable forming die may be adjusted and fixed in a respective height by a relatively simple adjusting technique that may include providing a preliminary model of a contoured surface that is to be imparted to an article, such as a sheet metal product, and then utilizing the preliminary model to adjust the heights of the pins. Once all of the pins are adjusted to their respective predesigned heights, the pins must be firmly secured in their positions so that the reconfigurable forming die can remain rigid and effective during a forming process.

In FIG. 1, a flow chart presenting a method 100 for adjusting and locking a reconfigurable forming die, according to one implementation of the present disclosure. Although some other implementations may include additional steps, in one implementation, the method 100 includes a first step 101 of providing a preliminary model of a contoured surface that is to be imparted to an article by the reconfigurable forming die. A second step 102 may include securing the preliminary model on the reconfigurable forming die, such that a contoured surface of the preliminary model is placed on a top surface of a forming side of the reconfigurable forming die. A third step 103 may include moving or repositioning pins of the reconfigurable forming die to a desired final arrangement, where distal ends of the pins touch the contoured surface of the preliminary model. A fourth step 104 may involve locking the pins at their final desired positions in order to allow the forming side of the reconfigurable forming die to remain rigid during a forming process. Additional details regarding this apparatus are provided herein below.

Figure 2:
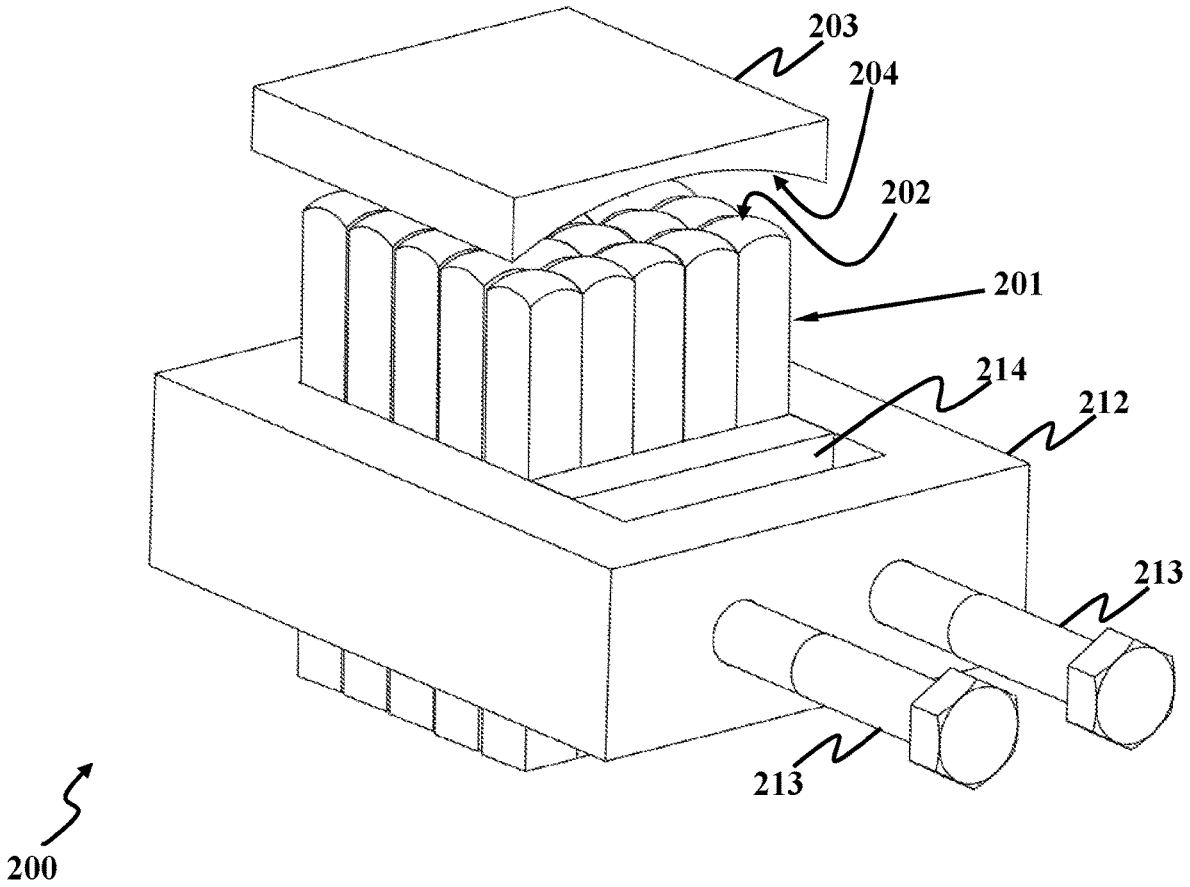
FIG. 2 illustrates a sectional view of an implementation of a reconfigurable forming die.

FIG. 2 shows a perspective view of a reconfigurable forming die 200, according to one implementation of the present disclosure. Referring to FIG. 2, the reconfigurable die 300 may include a plurality of pins 201. In one implementation, the plurality of pins 201 may be arranged in a matrix configuration, such that a number of rows of pins and a number of columns of pins are formed. The reconfigurable forming die 200 may further include a frame 212 for housing the rows and columns of the plurality of pins 201.

In different implementations, each of the pins 201 may be either a solid or a hollow pin. In addition, in different implementations, each of the pins 201 may be shaped in a variety of ways, which may be determined by the type and thickness of the workpiece that is to be formed in a particular application. Thus, in some implementations, the pins can be thicker or wider, while in other implementations, the pins may be more slender and narrow. Furthermore, while in some implementations the pins may be substantially similar to one another, in other implementations, two or more pins can differ from each other in shape, size, dimensions, material composition, and other features.

In some implementations, the reconfigurable forming die 200 may further include provisions for securing or locking pins into specified positions. For example, in FIG. 2, the reconfigurable forming die 200 includes one or more bolts 213 and a plate 214 that together can form a clamp. The bolt(s) 213 and plate 214 can be configured to lock the pins 201 in their respective positions.

As shown in FIG. 2, in order to adjust the reconfigurable forming die 200, a lower surface 204 of the preliminary model 203 may be secured close to top surfaces 202 of the pins 201. Loosening the bolts 213 can free the plate 214 and thereby may allow for movement of the pins 201 in a vertical direction and without any considerable friction. Thus, it may be understood that the pins are able to move or translate in a first direction substantially parallel to a vertical axis (thus, they can move either upward or downward). The pins are elongated and extend lengthwise along the first direction. In one implementation, in order to position the pins 201 at their desired respective heights, as the bolt(s) 213 is/are loosened, the reconfigurable forming die 200 may be turned upside down. Turning the reconfigurable forming die 200 upside down can allow for laying or moving the pins 201 such that their ends contact the lower surface 204 of the preliminary model 203. Thus, by rotating or re-orienting the die so that the preliminary model moves from being 'above' the die to being below the die, it can be understood that, as a result of gravity, the pins will move downward until they contact and/or press against the lower surface of the preliminary model.

According to some implementations, once all the pins 201 are laid on the lower surface 204 of the preliminary model 203, the bolt(s) 213 may be fastened or locked. The fastening ensures that the plate 214 is pressed or pushes toward the pins 201. The force that is exerted from the plate 204 to the pins 201 prevents the pins 201 from moving or repositioning in a vertical direction. Through this mechanism the rigidity of the reconfigurable forming die 300 under forming forces may be maintained. In one implementation, the bolts have a length that is substantially perpendicular to the first direction.

Figure 3:
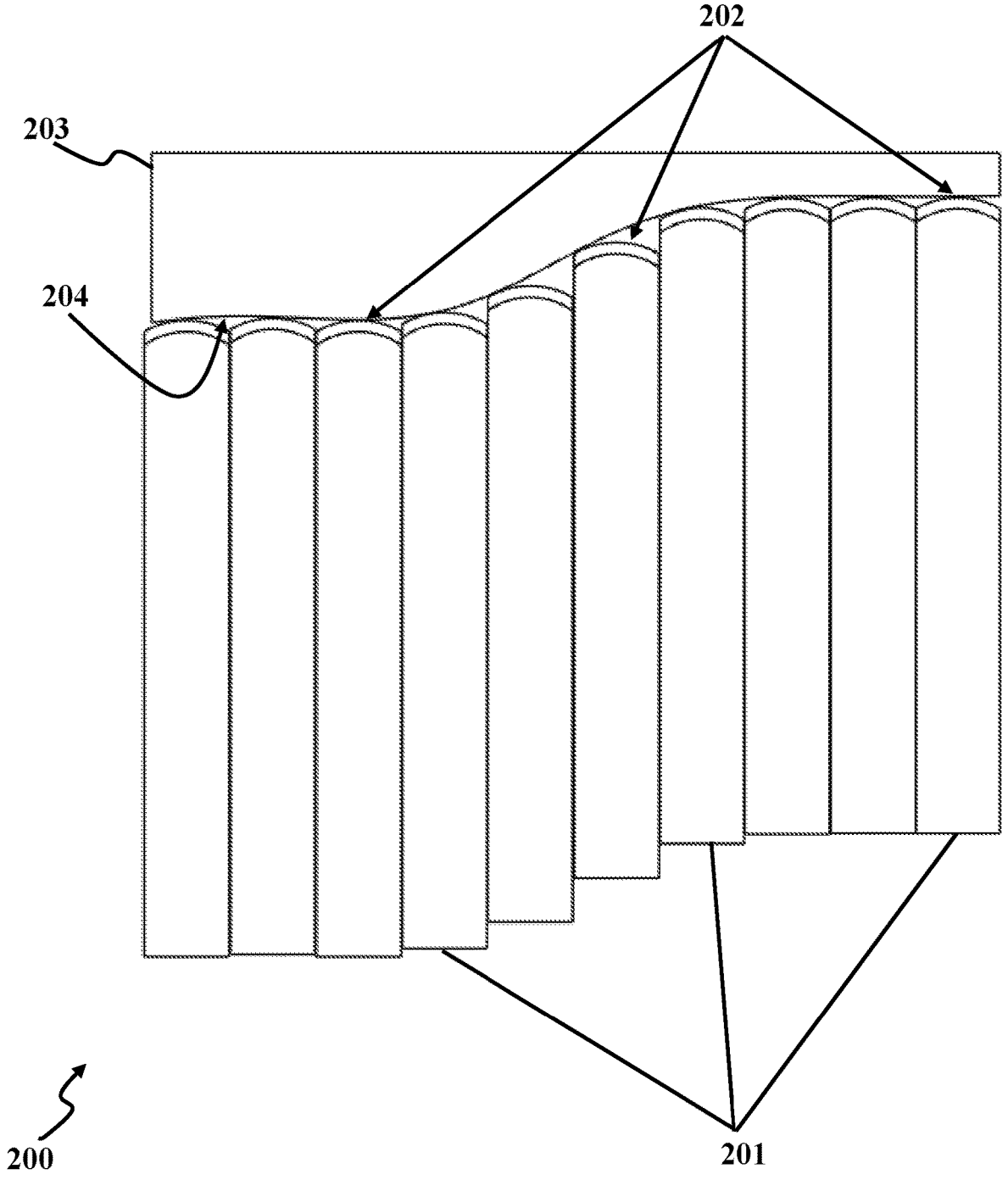
FIG. 3 illustrates a perspective view of an implementation of a reconfigurable forming die.

Referring now to FIG. 3, for purposes of clarity, a sectional view of a reconfigurable forming die 300 is provided, according to one implementation of the present disclosure. The reconfigurable forming die 300 may be understood to be similar to the reconfigurable die 200 of FIG. 2. As shown in FIG. 3, the reconfigurable forming die 300 may include plurality of pins 201. As noted above with respect to FIG. 2, the pins 201 are arranged closely to one another in a type of matrix configuration. The uppermost surfaces 202 of the plurality of pins 201 together create a forming surface of the reconfigurable forming die 300. The plurality of pins 201 may be adjustable, and configured to move such that their respective heights can be changed, which allows for a changing shape or contour of the forming surface. Thus, by adjusting the heights of one or more of the plurality of pins 201, the desired three dimensional surface can be produced.

In different implementations, the uppermost portion of each of the plurality of the pins 201 may include various three-dimensional shapes, including round or spherical shapes, square, rectangular, oval, elliptical, pentagonal, hexagonal, or other regular or irregular shapes. In addition, in one implementation, the top surfaces 202 of the plurality of the pins 201 may be spherically ground in order to impart various contours to the surface of a workpiece more accurately. Thus, each of the plurality of the pins 201 may be shaped in a variety of ways, which is largely determined by the type and thickness of the workpiece that is to be formed in a particular application. Furthermore, each of the plurality of the pins 201 may be a solid pin or a hollow pin.

As described above, in some implementations, the preliminary model 203 of the final surface of the product may be secured on the forming surface of the reconfigurable forming die 200. The pins 201 may then be moved or repositioned, such that the top surfaces 202 of the plurality of the pins 201 are substantially tangential to the lower surface 204 of the preliminary model 203 that includes the surface contours that are to be formed on the final product. The preliminary model 203 may include a sample of the final part with dimensions similar to that of the final part. In different implementations, the preliminary model 203 may be made of, for example, a relatively inexpensive material such as plastic or wood. However, in other implementations, it may include any other type of material that can include contours and has the rigidity to press against the pins. Furthermore, the preliminary model 203 may be manufactured via any manufacturing process. In one implementation, the preliminary model 203 may be manufactured via 3D-printing and polylactic acid (PLA) filaments may be used as the raw material for the 3D-printing process. Benefits from this implementation may include but are not limited to providing a preliminary model for positioning the pins 201 of the reconfigurable forming die 200 through a low-cost process. Once the pins 201 have been arranged in their desired final positions, in order for the reconfigurable forming die to be able to maintain its rigidity during a forming process, the plurality of the pins 201 may be locked in their respective desired final position.

Figure 4:
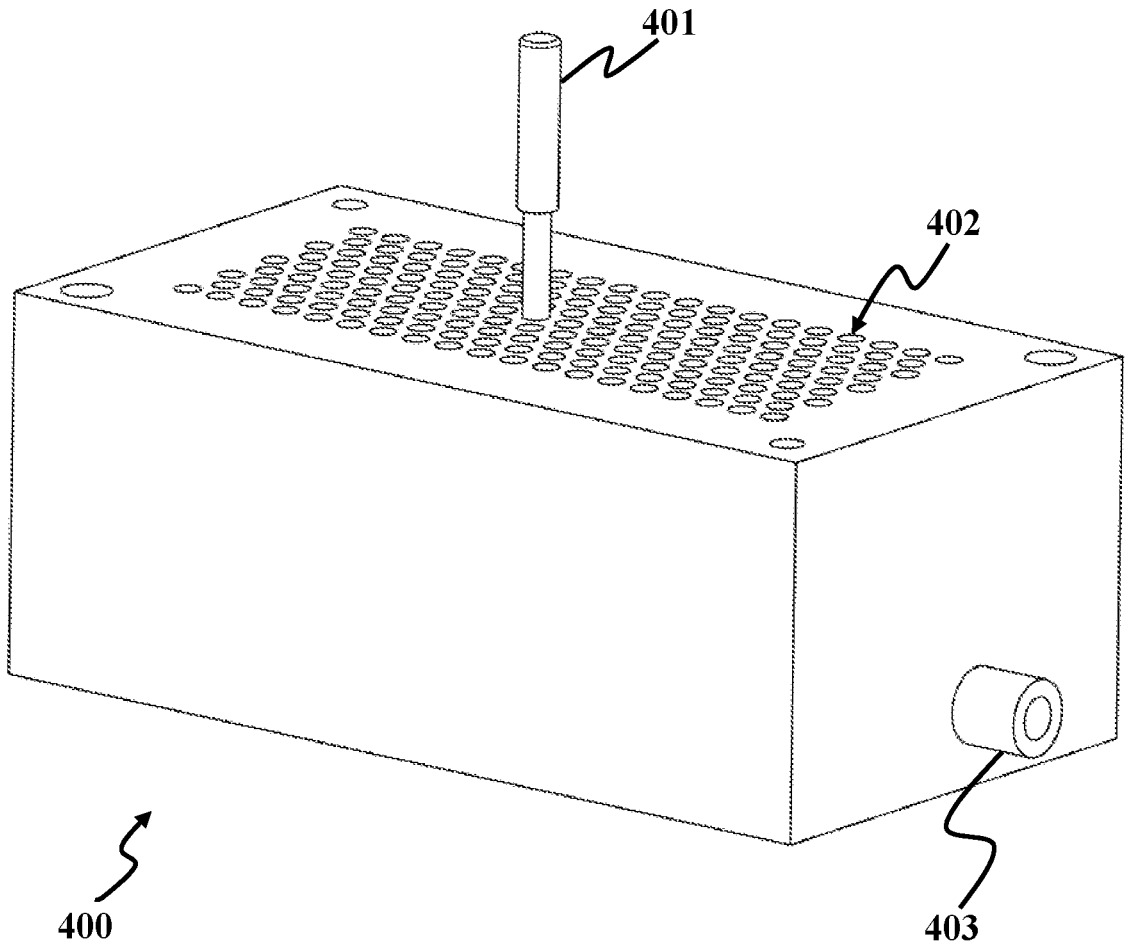
FIG. 4 illustrates an implementation of a matrix utilized in a reconfigurable forming die.

Referring next to FIG. 4, an implementation of a pin positioning mechanism utilized in a reconfigurable forming die is shown. In FIG. 4, it can be seen that in some implementations, the pin positioning mechanism may include a matrix holding member 400. The matrix holding member 400 can include a plurality of holes 402 that are arranged in a number of rows and a number of columns. In one implementation, the holes 402 may be in fluid communication with a hydraulic pump through an inlet 403. In some implementations, one or more of the pins 401 may be placed, inserted, positioned, or otherwise disposed in one of the holes 402. Furthermore, in one implementation, in order to reposition the pins 401, the pin positioning mechanism may include a hydraulic pump that can pump hydraulic oil into the holes 402 through the inlet 403. Hydraulic pressure of the hydraulic oil may push the pins 401 in an upward motion, or distally away from the pump, toward the preliminary model. In addition, a check valve may be used to prevent discharge of the oil from the holes 402 and thereby prevent the pins 401 from moving downward or repositioning under forming forces.

Figure 5:
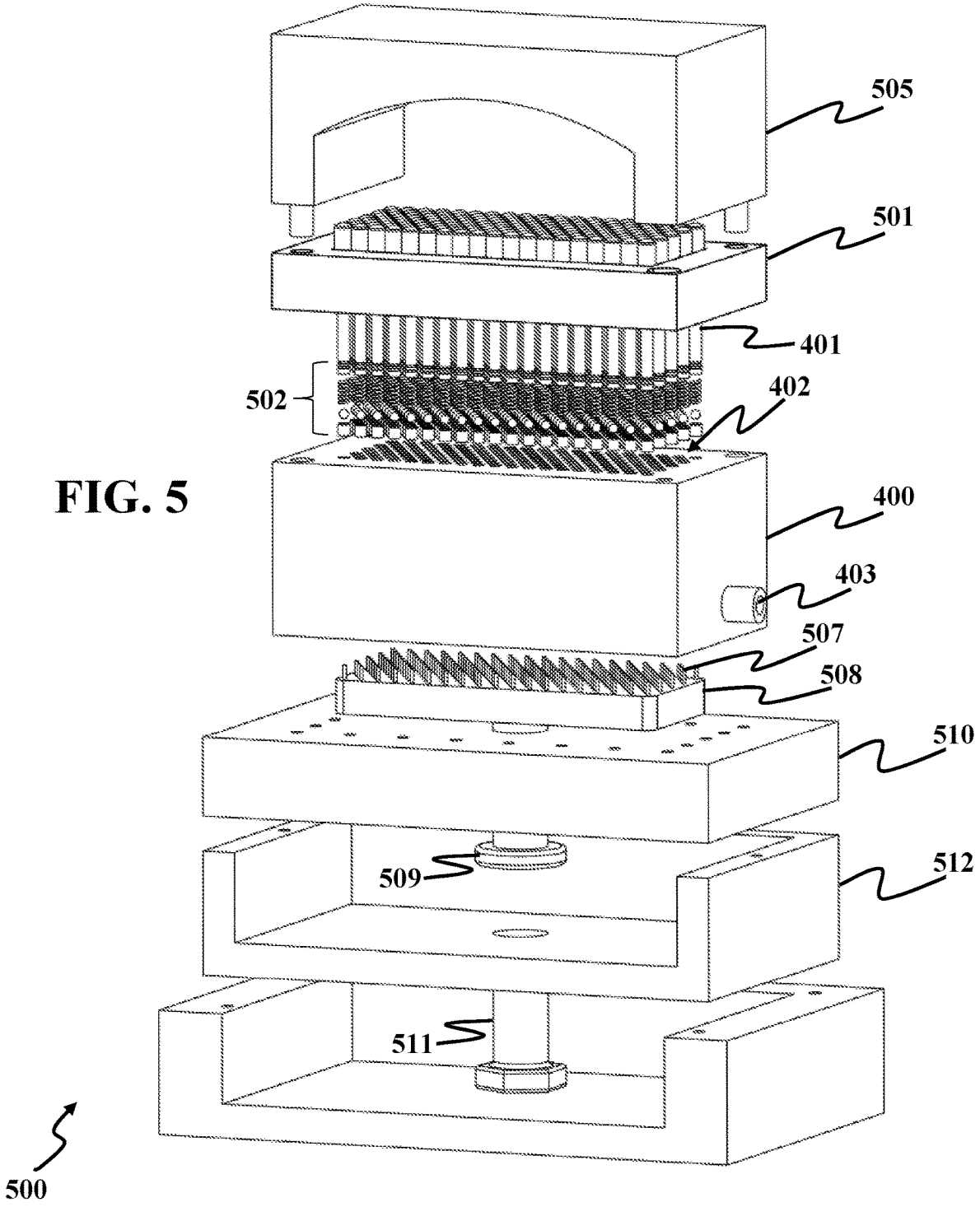
FIG. 5 illustrates an exploded view of an implementation of a reconfigurable forming die.

In order to provide additional detail to the reader, FIG. 5 shows an exploded view of a reconfigurable forming die 500, according to one or more implementations of the present disclosure. The reconfigurable forming die 500 may include a plurality of pins 401 that are arranged in a matrix of rows and columns and are secured within a frame 501. The reconfigurable forming die 500 may also include the matrix holding member 400 that can hold the pins 401. In one implementation, the number of the holes 402 of the matrix holding member 400 may be equal to the number of pins 401 present, and each pin 401 may be disposed in a respective hole 402. In order to adjust the reconfigurable forming die 500, a preliminary model 505 of the intended final product, in one non-limiting example a 3-D printed model of the intended final product, may be utilized. In some implementations, as shown in FIG. 5, the contoured surface of the preliminary model 505 of the intended final product may be secured to or contact the distal end of the pins 401 of the reconfigurable forming die 500. A hydraulic pump may then pump oil to the holes 402 through inlet 403. Pressurized pumped oil may push the pins 401 upward to the contoured surface of the preliminary model 505. Due to the different altitudinal position of different points on the contoured surface of the preliminary model 505, each pin 401 can be positioned at a different desired height. In another implementation, a check valve 502 may be provided and secured at the proximal end of each pin 401. The check valve 502 may prevent discharge of the oil from hole 402. The pressurized oil may help prevent vertical movement of the pins 401 under forming forces, thereby ensuring that the pins 401 are held or locked at their desired final positions.

With further reference to FIG. 5, in some implementations, the reconfigurable forming die 500 may further include a releasing matrix 508 on which a plurality of releasing pins 507 are mounted. Once the forming process is finished, the reconfigurable forming die may be reset to its initial configuration and made ready for reconfiguration. In order to reset the reconfigurable forming die 500 to its initial configuration, the pins 401 may be repositioned to their lowest position. In one implementation, a handle 509 may be attached to the releasing matrix 508. Pushing up or the handle 509 or moving the handle 509 in an upward direction can cause the releasing pins 507 to release all the check valves 502 and thereby all of the pins 401 may return to their initial positions, such that the reconfigurable forming die 500 is reset to its initial configuration. In some implementations, the releasing matrix may be mounted on a block 510 that is responsible for providing sealing for the matrix holding member 400 in order to avoid oil leakage. In another implementation, a bolt 511 may be mounted on a base 512 in order to allow an operator to trigger all of the releasing pins 507 and to release all the check valves 502 by fastening the bolt 511 and thereby resetting the reconfigurable forming die 500 to its initial configuration. In some other implementations, a hard thin rubber (or another elastomeric material) plate may be placed on top of or above the pins to protect the formed parts and ensure that bumps from the individual pin heads are not transmitted to the part. A further benefit from placing a hard thin rubber on top of the pins may include but is not limited to the smoother imparting of the contoured surface to the raw material.

Figure 6:
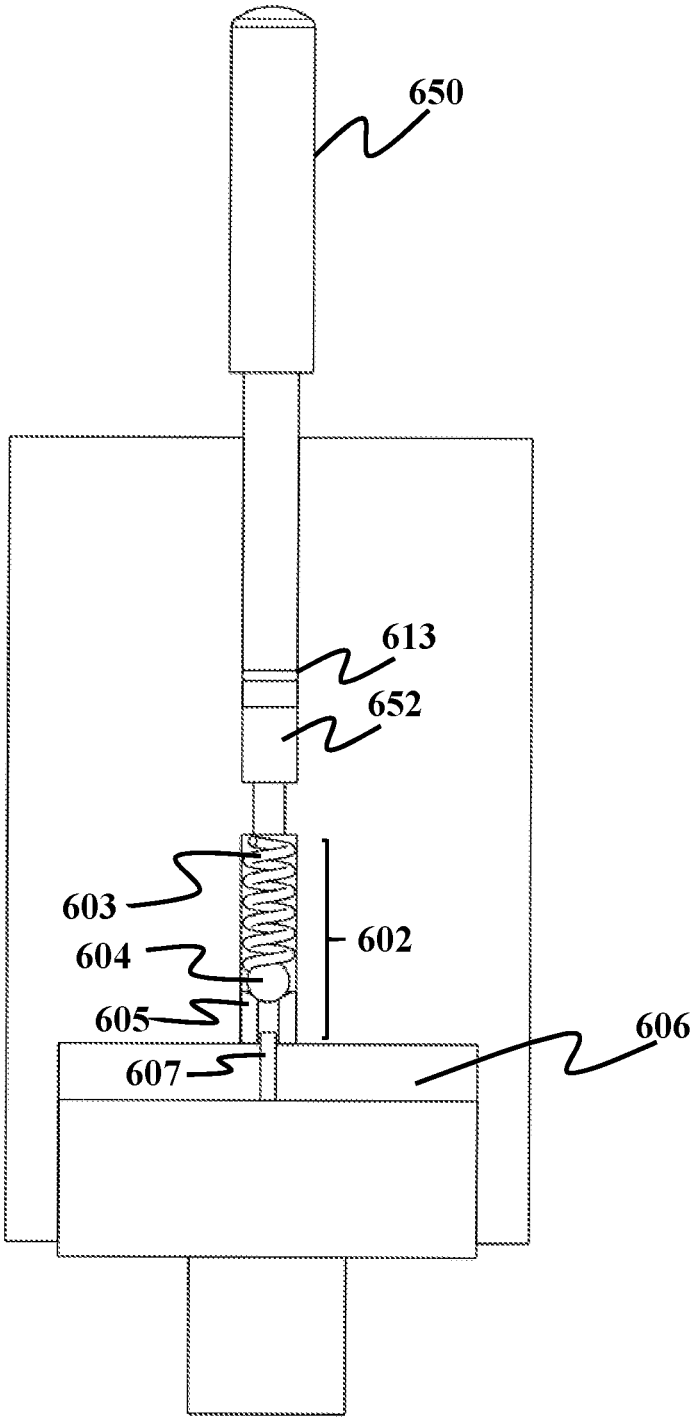
FIG. 6 illustrates a schematic view of an implementation of a pin of a reconfigurable forming die.

For additional clarity, FIG. 6 shows a schematic view of an implementation of a first pin 650 of the reconfigurable forming die 500. Referring to FIG. 6, a schematic view of the first pin 650 and its associated check valve 502 that may be used in the reconfigurable forming die 500 are illustrated. The check valve 502 may include a spring 603, a ball 604, and a set screw 605. The spring 603 may apply a compression preload to the ball 604 to hold it in contact with a conical surface of the set screw 605. In such a case, only one direction of flow that exerts a force against the spring 603 can separate the ball 604 from the conical surface of the set screw 605 and pass through the check valve 502. A hydraulic pump may pump the oil to a chamber 606 (oil input is not visible in FIG. 6) and then the oil may pass through the check valve 502 and flow to a first hole 652. In some implementations, in order to seal the first hole 652 and prevent the pressurized oil from discharging from around the first pin 650, an O-ring 613 may be utilized. As the first hole 652 is sealed by the check valve 502 and the O-ring 613, the pressurized oil may push the first pin 650 in an upward direction. Until the oil is pumped from the hydraulic pump, the first pin 650 may continue to move upward unless an obstacle, for example the preliminary model 505 which is placed in the way of the first pin 650, stops the first pin 650 from further movement in the upward direction. As the check valve 502 permits liquids to flow in only one direction, oil cannot return to chamber 606 and consequently the oil may be pressurized in the first hole 652. As the first hole 652 is sealed by the check valve 502 and the O-ring 613, the pressurized oil may prevent the first pin 650 from repositioning or vertical translation under forming forces even after picking up the preliminary model 505. In one implementation, in order to return the first pin 650 to its initial position, a first releasing pin 607 may be used. The first releasing pin 607 may push up the ball 604 and the ball 604 is displaced and thereby the pressurized oil in the first hole 652 may be discharged to the chamber 606 through a gap that may be created between the ball 604 and the set screw 605 due to the displacement of the ball 604. Discharging the pressurized oil may allow the first pin 650 to move downward and attain its initial position. According to one implementation, all pins, plates and frame materials that are described in the above disclosure may be formed of heavy steel to assure that the reconfigurable forming die is rugged and may maintain maximum tool rigidity.

Figure 7:
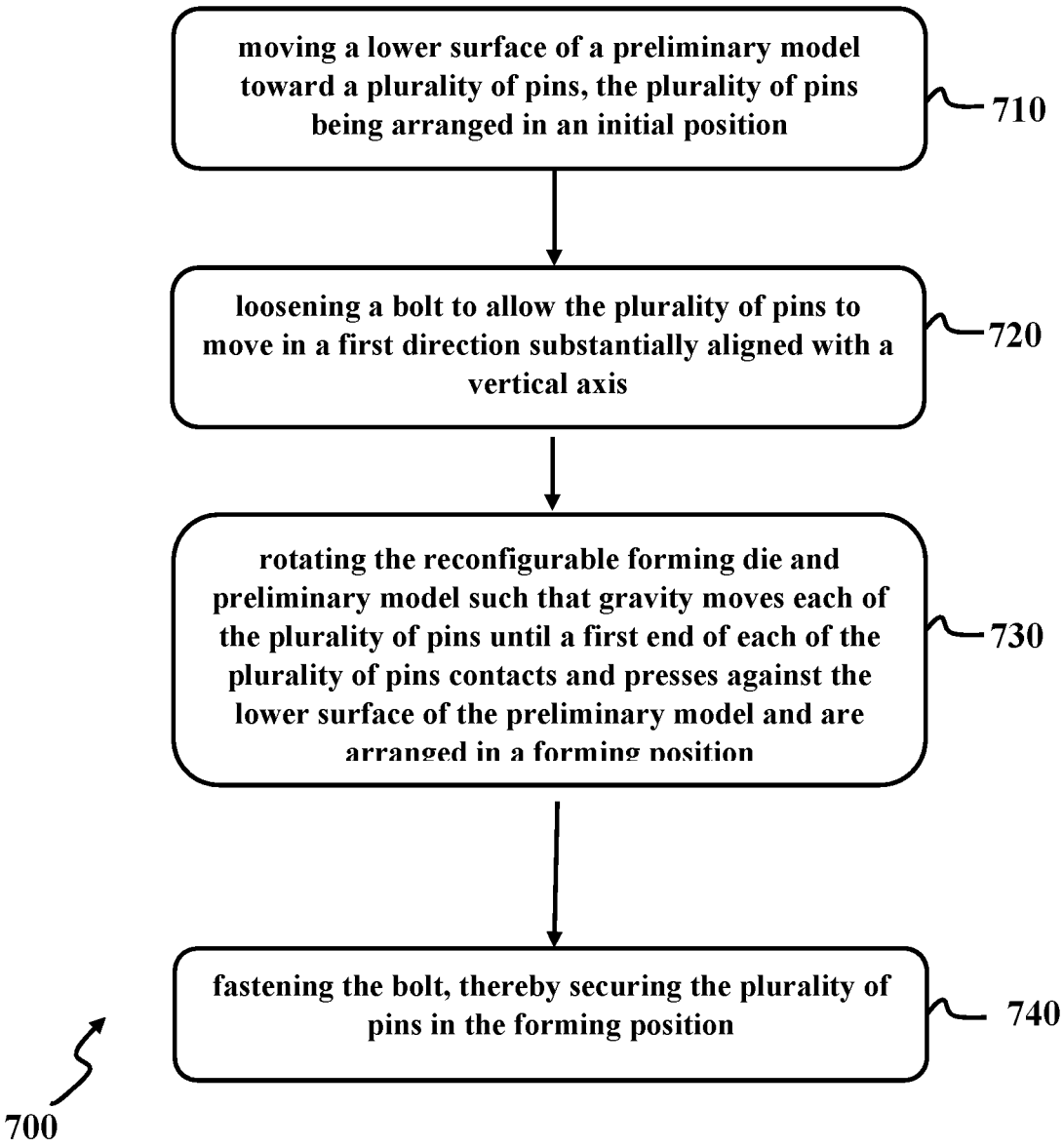
FIG. 7 illustrates a flow chart presenting an implementation of a method of adjusting and securing pins of a reconfigurable forming die.

In order to better appreciate the disclosed forming system, FIG. 7 presents a flow chart in which a method 700 of adjusting and securing pins of a reconfigurable forming die is provided. As shown in FIG. 7, a first step 710 involves moving a lower surface of a preliminary model toward a plurality of pins, where the plurality of pins is arranged in an initial position. A second step 720 includes loosening a bolt to allow the plurality of pins to move in a first direction substantially aligned with a vertical axis. In a third step 730, the reconfigurable forming die and preliminary model are rotated such that gravity moves each of the plurality of pins until a first end of each of the plurality of pins contacts and presses against the lower surface of the preliminary model and are arranged in a forming position. A fourth step 740 includes fastening the bolt, thereby securing the plurality of pins in the forming position.

In other implementations, there may be additional steps. For example, in some cases, the plurality of pins can be arranged in a matrix, and fastening the bolt involves pushing a plate against one side of the matrix. In addition, in some implementations, the method includes positioning the plurality of the pins such that the first end of each of the pins is substantially tangential to the lower surface of the preliminary model, thereby forming surface contours along the upper most portion of the pins that are substantially similar or correspond to that of the lower surface of the preliminary model. The method may also involve inserting each of the plurality of pins into a corresponding hole formed in a matrix holding member, each hole being in fluid communication with a hydraulic pump. In some cases, there may be a step of pumping hydraulic oil into each of the holes. In another implementation, there can be a three dimensional printing of the preliminary model using polyactic acid filaments as printing material. In some cases, the method may include preventing vertical movement of the plurality of pins by application of hydraulic pressure. In other implementations, the method can involve loosening the bolt and returning the plurality of pins to the initial position.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A reconfigurable forming die for use in a forming system, the reconfigurable forming die comprising:

a plurality of pins arranged in a matrix configuration, the plurality of pins configured to move along a first axis;

a frame configured to house the plurality of pins, the frame comprising a bolt hole at a lateral side of the frame;

a plate disposed inside the frame and adjacent to the plurality of pins, a main plane of the plate parallel to the first axis; and a first bolt disposed inside the bolt hole, a first externally threaded section of the first bolt engaged with a first internally threaded section of the bolt hole, the first bolt movable along a second axis, the second axis perpendicular to the first axis, the first bolt configured to secure the plurality of pins into a fixed position responsive to fastening the first bolt inside the bolt hole due to the first bolt pushing the plate along the second axis and against the plurality of pins.

2. The reconfigurable forming die of claim 1, further comprising a plurality of holes, wherein each respective hole from the plurality of holes is configured to receive a respective pin from the plurality of pins.

3. The reconfigurable forming die of claim 2, wherein the first bolt is configured to allow the plurality of pins to move along the first axis responsive to loosening the first bolt inside the bolt hole.

4. The reconfigurable forming die of claim 3, wherein an uppermost surface of at least one of the plurality of the pins is spherically ground.

5. The reconfigurable forming die of claim 4, further comprising a pin positioning mechanism configured to hold the plurality of pins in a matrix arrangement, the pin positioning mechanism comprising a hydraulic pump, each of the plurality of holes in fluid communication with the hydraulic pump through an inlet, the hydraulic pump configured to pump a hydraulic oil into the plurality of holes, wherein:

the hydraulic oil is configured to apply an upward force to the plurality of pins; and the hydraulic oil is configured to urge the plurality of pins to move upward along the first axis.

6. The reconfigurable forming die of claim 5, further comprising a pin positioning mechanism configured to hold each of the pins in a matrix arrangement, the pin positioning mechanism comprising the plurality of holes, each of the plurality of holes comprising a through-hole.

7. The reconfigurable forming die of claim 6, wherein the pin positioning mechanism further comprises a plurality of check valves configured to prevent discharge of the hydraulic oil from each of the plurality of holes.

8. The reconfigurable forming die of claim 7, wherein each pin of the plurality of pins configured to be adjusted to a different height relative to an adjacent pin from the plurality of pins.

9. The reconfigurable forming die of claim 7, further comprising a release mechanism configured to return the plurality of pins to the plurality of pins' initial position, the release mechanism comprising:

a releasing matrix;

a plurality of releasing pins fixedly mounted onto the releasing matrix, each respective releasing pin from the plurality of releasing pins associated with a respective check valve from the plurality of check valves, a respective pin from the plurality of pins, and a respective hole from the plurality of holes, each respective releasing pin from the plurality of releasing pins responsive to triggering a respective check valve from the plurality of check valves configured to trigger the respective check valve from the plurality of check valves, wherein:

the hydraulic oil is configured to discharge from the respective hole, and the respective pin is configured to return to the respective pin's initial position.

10. The reconfigurable forming die of claim 9, further comprising a handle attached to the releasing matrix, wherein responsive to moving the handle in an upward direction, each respective releasing pin from the plurality of releasing pins triggers the respective check valve from the plurality of check valves.

11. The reconfigurable forming die of claim 9, wherein the pin positioning mechanism further includes a matrix holding member, and wherein the releasing matrix is mounted on a block that provides sealing for the matrix holding member and limits oil leakage.

12. The reconfigurable forming die of claim 7, wherein each check valve includes a spring, a ball, and a set screw, and the spring is configured to apply a compression preload to the ball and hold the ball in contact with a conical surface of the set screw.

13. The reconfigurable forming die of claim 1, further comprising an elastomeric material disposed directly above the plurality of pins.

* * * * *